United States Patent [19]

Weissman

[11] Patent Number: 4,724,602

[45] Date of Patent: Feb. 16, 1988

[54] AUTOTRANSFORMER WITH COMMON WINDING HAVING OPPOSITELY WOUND SECTIONS

[75] Inventor: Adrian M. Weissman, West Orange, N.J.

[73] Assignee: Universal Manufacturing Corporation, Paterson, N.J.

[21] Appl. No.: 838,467

[22] Filed: Apr. 15, 1986

Related U.S. Application Data

[62] Division of Ser. No. 507,163, Jun. 23, 1983, Pat. No. 4,590,453.

[51] Int. Cl.[4] ..... H01F 7/06

[52] U.S. Cl. ..... 29/605

[58] Field of Search ..... 29/605; 336/147, 148, 336/180–182, 186, 187

[56] References Cited

U.S. PATENT DOCUMENTS 3,144,628 8/1964 Rabins ..... 336/147

3,443,255 5/1969 Massar ..... 336/181

*Primary Examiner*—P. W. Echols

*Attorney, Agent, or Firm*—Darby & Darby

[57] ABSTRACT

The common winding of an autotransformer is formed in two sections connected electrically in parallel and one section overlying the other. One section is wound clockwise and the other is wound counterclockwise. This reduces the voltage difference between adjacent layers of the two sections, permits the use of a smaller wire, and results in cooler and more efficient operation.

10 Claims, 3 Drawing Figures

AUTOTRANSFORMER WITH COMMON WINDING HAVING OPPOSITELY WOUND SECTIONS

This is a division of application Ser. No. 507,163, filed June 23, 1983, now U.S. Pat. No. 4,590,453.

BACKGROUND OF THE INVENTION

This invention relates to transformers and, more particularly, to a novel and highly effective autotransformer that employs smaller wire and generates less waste heat than conventional autotransformers.

Autotransformers have a wide range of applications and include very small ones used, for example, in lighting circuits, and very large ones used, for example, in supplying power to locomotives. Because of their importance, a great deal of attention has been given to their improvement. However, the best autotransformers available today generate a substantial amount of waste heat in operation and require the use of wire of fairly large cross section. This is due to the conventional method of winding the common sections, which is to wind all such sections in the same clock direction.

SUMMARY OF THE INVENTION

An object of the invention is to provide an improved autotransformer that employs smaller wire, generates less waste heat, and normally operates at less elevated temperatures than conventional autotransformers.

Another object of the invention is to provide an autotransformer wherein the voltage difference between successive layers of winding is minimized.

Another object of the invention is to provide a method of constructing an autotransformer that is continuous, efficient and economical.

The foregoing and other objects are attained in accordance with the invention by providing an autotransformer comprising a common winding formed in at least two sections, one section being wound clockwise and the other being wound counterclockwise.

The two sections are connected electrically in parallel so that their magnetic fields reinforce and are wound with wire of a single gauge, thus facilitating precision winding.

BRIEF DESCRIPTION OF THE DRAWING

A better understanding of the invention may be gained from the following detailed description of the preferred embodiments thereof, in conjunction with the appended drawing, wherein.

DESCRIPTION OF THE PREFERRED EMBODIMENTS

Figure 1:
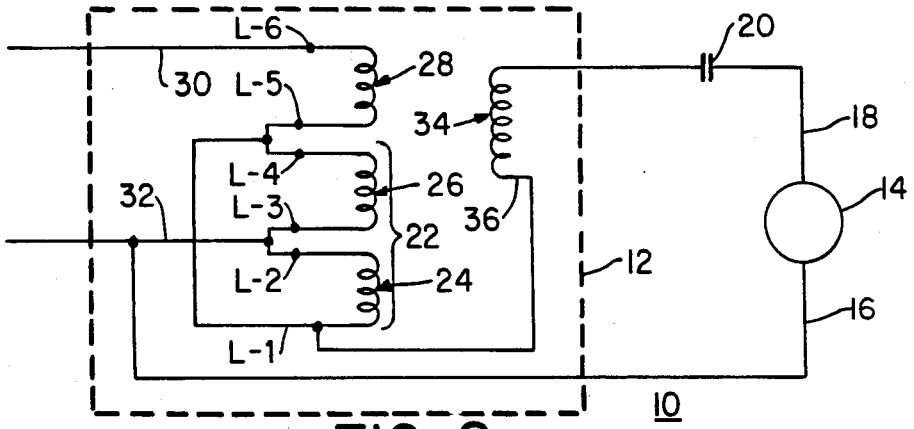
FIG. 1 is a circuit diagram of electrical apparatus including an autotransformer constructed in accordance with the invention.

FIG. 1 shows apparatus 10 including an autotransformer 12 constructed in accordance with the invention. In the example shown, the apparatus 10 includes an HID lamp 14 connected by leads 16 and 18 and a capacitor 20 to the autotransformer 12. The invention relates to the autotransformer 12, which has many applications besides the one shown.

Figure 2:
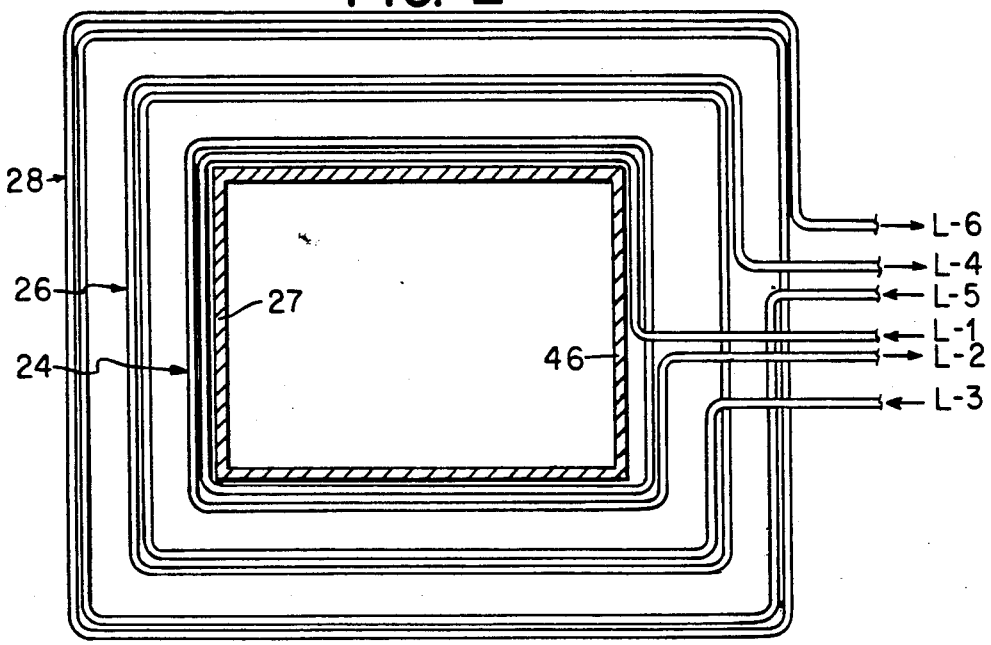
FIG. 2 is a simplified schematic view in axial cross section of the primary and common portions of the autotransformer of FIG. 1.
Figure 3:
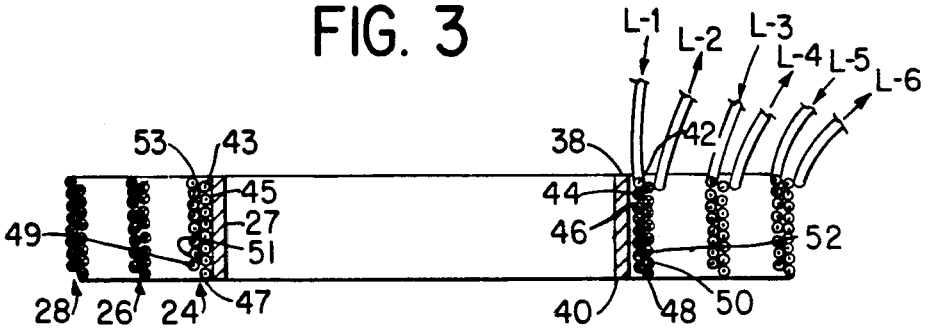
FIG. 3 is a view in longitudinal section of the structure of FIG. 2.

The autotransformer 12 comprises a common winding 22 formed in at least two sections 24 and 26, one section being wound clockwise and the other being wound counterclockwise around a bobbin core 27 (FIGS. 2 and 3). The two sections 24 and 26 are connected electrically in parallel, and each section 24 and 26 comprises the same number of turns.

The sections 24 and 26 are wound with wire of a single gauge and are preferably precision-wound: i.e., the wire in each layer makes the same number of turns, and the turns of successive layers are not randomly placed but are neatly stacked or nested one on top of another.

The autotransformer 12 further comprises a primary winding 28 additional to the common winding 22, the additional primary winding 28 and the two sections 24 and 26 being disposed in overlying relation. The two sections 24 and 26 are adjacent to each other, and the additional primary winding 28 is wound in the same direction as the section (26 for example) to which it is adjacent. Typically the additional primary winding 28 will be the outermost or innermost winding.

The autotransformer 12 further comprises a high-voltage line 30, a neutral line 32, and a secondary winding 34 additional to the common winding 22. There are provided first and second leads L-1 and L-2 for one section, for example the section 24, of the common winding 22, third and fourth leads L-3 and L-4 for the other section 26 of the common winding 22, and fifth and sixth leads L-5 and L-6 for the additional primary winding 28.

The first, fourth and fifth leads L-1, L-4 and L-5 are electrically connected to one another and to one side 36 of the additional secondary winding 34; the second and third leads L-2 and L-3 are electrically connected to each other and to the neutral line 32; and the sixth lead L-6 is electrically connected to the high-voltage line 30.

FIGS. 2 and 3 show certain physical characteristics of the primary and common portions of the autotransformer 12, but, for simplicity, only two layers of turns per section are shown. In practice, sections 24 and 26 may have many more than two layers, but they should always have the same number of turns.

The section 24 between leads L-1 and L-2 is wound counterclockwise as seen in FIG. 2 from one axial end of the core 27 to the other to form a first layer, counterclockwise as seen in FIG. 2 from said other axial end of the core 27 back to the first axial end to form a second layer, and so on back and forth to complete the section 24. The number of layers N1 so wound is an integer. If the number is even, the winding machine is back at its starting point upon completion of the winding of the first section 24. If the number is odd, the winding machine is at the opposite axial end of the core 27 upon completion of the winding of the first section 24.

The winding machine then reverses the clock direction of winding so that the section 26 between the leads L-3 and L-4 is wound clockwise so that its magnetic field reinforces that of winding 24, as seen in FIG. 2, from one axial end of the core to the other to form a first layer, clockwise as seen in FIG. 2 from said other axial end of the core 27 back to the first axial end to form a second layer, and so on back and forth to complete the section 26. The number of turns so wound is equal to the number wound on the section 24. In the case of precision winding, the number of layers of turns in the section 26 is equal to the number of layers of turns in the section 24.

The winding machine then preferably continues winding in the same direction so that the section 28 between the leads L-5 and L-6 is wound in the same direction (clockwise in the example) as the section 26. The winding proceeds back and forth as before from one axial end of the core 27 to the other to form as many layers N2 in the section 28 as may be necessary. The number N2 need not be equal to the number N1.

In FIG. 3, the above-mentioned first axial end of the bobbin core 27 is designated as 38 and the second axial end as 40. Of course these designations are arbitrary, and the winding may be begun at either end. The selection of the counterclockwise direction as the direction of winding of the first section 24 is likewise arbitrary, and one may as well start with the clockwise direction, the winding directions of succeeding sections being likewise reversed. In fact, what appears as the clockwise direction as viewed in one axial direction becomes the counterclockwise direction as viewed in the opposite axial direction.

In FIG. 3, the direction of winding can be followed by noting the dot or x shown in the respective wire cross sections. A dot indicates that, in tracing in the direction from L-1 to L-2, for example, the wire at the point where the dot is located is coming up out of the plane of the figure; an x indicates that, in tracing in the direction from L-1 to L-2, for example, the wire at the point where the x is located is going down into the plane of the figure. Thus the wire goes in succession from L-1 through points 42, 43, 44, 45, 46, and so on to point 47 to complete the first layer, then goes in the opposite axial direction (but in the same counterclockwise direction as viewed in FIG. 2) in succession through points 48, 49, 50, 51, 52, and so on to point 53 to complete the second layer. This process is continued to construct the entire assembly.

On an actual coil assembly there are no spaces, or only negligible spaces, between successive layers of wire; the exaggerated spaces in FIGS. 2 and 3 are for illustrative purposes only.

It is of course immaterial whether the turns are laid on by rotating a paying-out means (not shown) around the bobbin 27 or by rotating the bobbin 27 about its axis.

An autotransformer in accordance with the invention has some significant advantages. There is better utilization of copper cross section, more uniform current density, lower losses, lower temperature rise, and a lower voltage difference between adjacent layers of the coil. Moreover, the wire used for the winding requires no insulation other than the enamel with which it is coated. This results in a more economical and more compact structure.

For example, in a conventional 400 W MH ballast, using a given magnetic structure and given laminations, the highest temperature rise and lowest efficiency results when 480 V is employed. This is a consequence of unequal current densities in the primary coil. The large number of turns required by the 480 V requires the use of a relatively small gauge wire for the coil, while the current that flows in the common part of the primary is higher than that in the remainder of the primary and causes excessive heating.

Because of the method of winding in accordance with the invention, the resultant copper cross section is larger in the common portion 22, and the primary $I^2R$ losses are reduced, so that the temperature rise is lower and the efficiency higher.

EXAMPLE

A conventional 480 V 400 W MH ballast (specimen A) had a primary wound with 21 AWG, and another 480 V 400 W MH ballast (specimen B) constructed in accordance with the invention had a primary wound with 22 AWG. Tests produced the results shown in the following table.

| | Current (A) | Cross Section ($in^2$) | Current Density ($A/in^2$) | Resistance (Ω) | Losses (W) | Temp. Rise (°C.) |
|---|---|---|---|---|---|---|
| Specimen A | | | | | | |
| Line Side | 1.0 | .0006379 | 1568 | 5.54 | 5.5 | 89 |
| Common Side | 2.6 | .0006379 | 4076 | 2.33 | 15.8 | 86 |
| Specimen B | | | | | | |
| Line Side | 1.0 | .0005027 | 1989 | 7.62 | 7.6 | 77 |
| Common Side | 2.6 | .010054 | 2586 | 1.13 | 7.6 | 82 |

Total losses were thus 21.3 W in the case of Specimen A and only 15.2 W in the case of Specimen B; and the temperature rise in the use of Specimen B was correspondingly less.

Thus there is provided in accordance with the invention a novel and highly effective autotransformer that employs a smaller wire and generates less waste heat than conventional autotransformers. The voltage between sections does not exceed twice the voltage per layer (as is standard practice in precision winding). Many modifications of the preferred embodiments of the invention disclosed above will readily occur to those skilled in the art upon consideration of this disclosure. For example, the wire size and number of layers may be varied without wide limits, depending on the purpose for which the autotransformer is intended. Accordingly, the invention is to be construed as including all structures and methods which are respectively within the scope of the appended claims.

What is claimed is:

1. A method of constructing an autotransformer including a common winding, comprising the steps of:

winding one section of said common winding in one direction about a predefined axis, from a first conductor end thereof to a second conductor end thereof, to form at least one layer of turns, winding another section of said common winding in the opposite direction about said axis from a first conductor end thereof to a second conductor end thereof, said other section being positioned to form at least one additional layer of turns overlying said at least one layer, the number of turns in each of said sections being equal, and connecting the first conductor end of said one section to the second conductor end of said other section and connecting the second conductor end of said one section to the first conductor end of said other section, so that said one and other sections of the common winding are magnetically coupled so that their fields reinforce while being electrically in parallel so that said one and said other section share the current load of the common winding.

2. A method according to claim 1 wherein successive turns of successive layers in each section progress in opposite axial directions and the same direction about said axis.

3. A method according to claim 1 wherein an integral number of layers is included in each of said sections.

4. A method for manufacturing a transformer having a magnetic circuit assembly with a common winding having at least first and second sections and being formed from an electrical conductor, each of the first and second sections having first and second conductor ends, said method comprising the steps of:

winding the first section in a first winding direction from its first conductor end to its second conductor end;

winding the second section from its first conductor end to its second conductor end in a second winding direction opposite to said first winding direction so that the second section is disposed in overlying relationship to the first section; and electrically connecting the second conductor end of the first section with the first conductor end of the second section;

electrically connecting the first conductor end of the first section with the second conductor end of the second section;

whereby the first and second sections of the common winding are magnetically coupled to reinforce the magnetic field of each section and electrically connected in parallel so that each said section shares a current load of the common winding.

5. A method in accordance with claim 4 wherein each of said sections includes the same number of turns.

6. The method of claim 4 wherein said sections are wound with wire of a single gauge.

7. The method of claim 6 wherein said sections are precision-wound.

8. The method in accordance with claim 4 further comprising the steps of:

forming said first and second sections so as to be in an overlying, adjacent relationship, forming an additional primary winding in overlying relationship to said first and second sections and adjacent to one thereof, said additional primary winding being wound in the same winding direction as the section to which it is adjacent.

9. The method in accordance with claim 8, wherein said additional primary winding is formed as the outermost winding.

10. The method in accordance with claim 8, wherein said additional primary winding is formed as the innermost winding.

* * * * *